US007293331B2

(12) United States Patent
Lawless

(10) Patent No.: US 7,293,331 B2
(45) Date of Patent: Nov. 13, 2007

(54) PRY BAR HANDLE

(75) Inventor: John C. Lawless, Charlemont, MA (US)

(73) Assignee: Mayhew Steel Products, Inc., Turner Falls, MA (US)

( * ) Notice: Subject to any disclaimer, the term of this patent is extended or adjusted under 35 U.S.C. 154(b) by 0 days.

(21) Appl. No.: 10/891,816

(22) Filed: Jul. 15, 2004

(65) Prior Publication Data

US 2004/0255428 A1 Dec. 23, 2004

Related U.S. Application Data

(62) Division of application No. 10/420,432, filed on Apr. 22, 2003, now Pat. No. 6,772,994.

(51) Int. Cl.
*E05C 17/64* (2006.01)

(52) U.S. Cl. ..... 16/430; 16/DIG. 12; 16/DIG. 19; 81/489

(58) Field of Classification Search ..... 16/430, 16/110.1, 421, 431, 436, DIG. 12, 19 X; 81/177.1, 177.4, 177.8, 489; 294/25; 15/143.1, 15/105; 30/169.5, 167, 169; D8/82, 83
See application file for complete search history.

(56) References Cited

U.S. PATENT DOCUMENTS 1,049,650 A * 1/1913 Benjamin ..... 81/436
1,435,088 A * 11/1922 Smith ..... 473/302
1,825,077 A * 9/1931 Lawrence ..... 219/237
2,391,247 A * 12/1945 Knudtson ..... 30/2
2,984,486 A * 5/1961 Jones ..... 473/568
D256,546 S * 8/1980 Holland-Letz ..... D8/83
4,552,713 A * 11/1985 Cavicchioli ..... 264/162
4,739,536 A * 4/1988 Bandera et al. ..... 16/430
5,781,963 A * 7/1998 Maru et al. ..... 16/430
D447,926 S * 9/2001 Chen ..... D8/107
6,471,186 B1 * 10/2002 Lawless ..... 254/25
D481,922 S * 11/2003 Yu et al. ..... D8/107
6,772,994 B1 * 8/2004 Lawless ..... 254/25
2004/0221425 A1 * 11/2004 Lawless ..... 16/430

FOREIGN PATENT DOCUMENTS

DE 2344673 A1 * 3/1975
FR 2736296 A3 * 1/1997

* cited by examiner

*Primary Examiner*—Brian E. Glessner
*Assistant Examiner*—Mark Williams
(74) *Attorney, Agent, or Firm*—Lackenbach Siegel, LLP

(57) ABSTRACT

A pry bar has generally octagonal cross-section handle with a grip portion having four rounded surfaces formed of a soft elastomeric material and four alternating surfaces formed of hard thermoplastic material. The elastomeric material rounded surfaces are formed with pluralities of small orifices. The handle is formed with an inner hard thermoplastic core and molded over outer elastomeric cover. A metal impact cap is fixed secured in the handle proximate end.

14 Claims, 3 Drawing Sheets

FIG.4
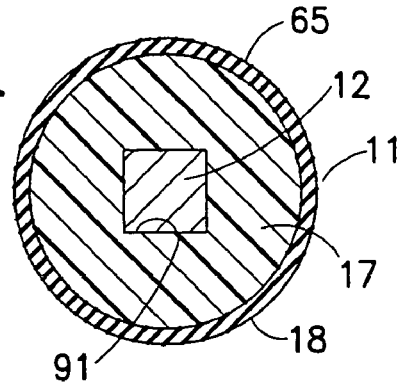
FIG.5
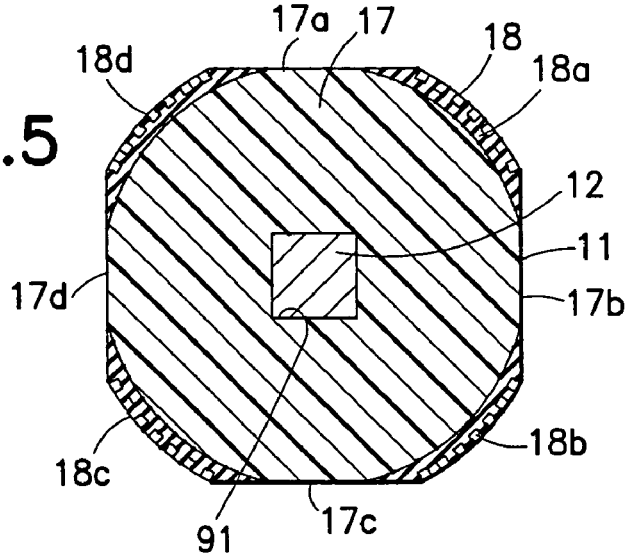
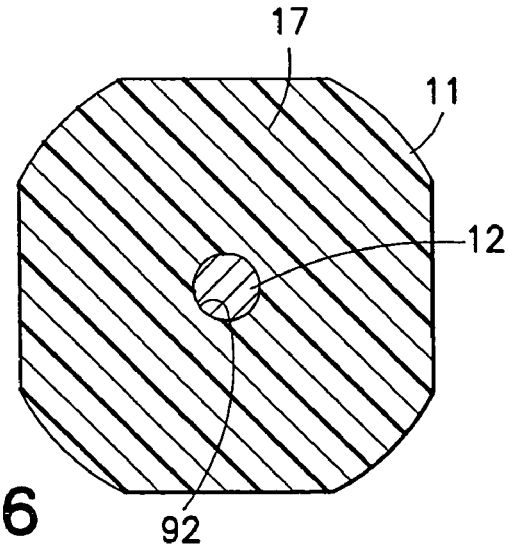
FIG.6

PRY BAR HANDLE

This is a divisional of U.S. patent application Ser No. 10/420,432 now U.S. Pat. No. 6,772,994.

FIELD OF THE INVENTION

This invention relates to hand tools and hand tool handles. This invention specifically relates to pry bars and pry bar handles. This invention specifically relates to an ergonomic handle for hand tools particularly a pry bar.

BACKGROUND AND DISCUSSION OF THE PRIOR ART

In general, pry bars are of all metal construction and are cumbersome to grip and use. Often the user has to grip a polygonal cross-sectional metal bar portion of the pry bar. One such prior art construction is disclosed in U.S. Pat. No. 6,058,809 to Flanz.

A wrecking tool is disclosed in U.S. patent application Publication No. 2002/0134971 to Christensen. The Christensen tool has an elongate octagonal cross-sectional metal handle or bar stock portion. A non-octagonal handgrip is attached to the octagonal metal bar.

It is generally known to provide a soft elastomeric molded over cover on a molded hard thermoplastic core for improved grip for knives, screwdrivers, and the like bladed tools. Such prior art constructions are disclosed in Sanelli, U.S. Pat. No. 4,712,304; Gakhar, U.S. Pat. No. 5,390,572; Hoepfl, U.S. Pat. No. 5,964,009; and Panaccione, U.S. Pat. No. 5,956,799.

The pry bar art desires an improved handle so as to provide improved grip with ergonomic functionality.

It is therefore a principal object of the present invention to provide an ergonomic handle for hand tool such as a pry bar.

It is another object of the present invention to provide an improved grip hand tool and pry bar handle.

It is still a further object of the present invention to provide an ergonomic pry bar handle that is of practical design and safe and practical in use.

Present applicant is the inventor of the ergonomic pry bar handle disclosed in U.S. Pat. No. 6,471,186, granted Oct. 29, 2002, which patent and the present application are commonly assigned to Mayhew Steel Products, Inc.

SUMMARY OF THE INVENTION

A pry bar has a handle with a generally octagonal cross-section with eight grip surfaces. Four of the grip surfaces have hard thermoplastic planar surfaces and four alternating grip surfaces have rounded soft thermoplastic material surfaces. The rounded soft thermoplastic material surfaces have a plurality of rows of small orifices. The user grips the alternating surfaces for a secure ergonomic grip in pry bar operations.

BRIEF DESCRIPTION OF THE DRAWINGS

FIG. 4 is a sectional view taken along line 4-4 of FIG. 3;

FIG. 5 is a sectional view taken along line 5-5 of FIG. 3; and

FIG. 6 is a sectional view taken along line 6-6 of FIG. 3.

DESCRIPTION OF THE PREFERRED EMBODIMENT

Figure 1:
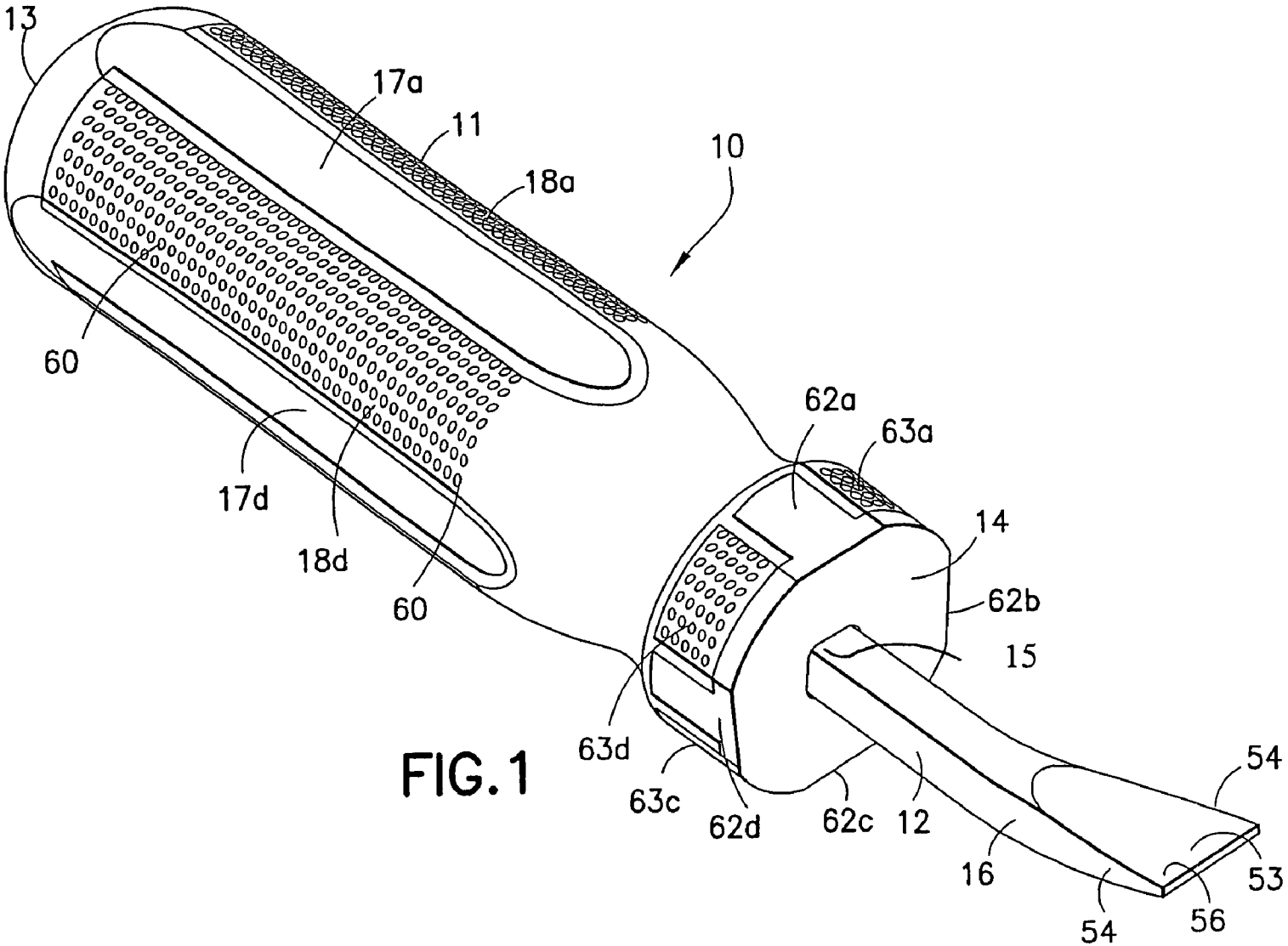
FIG. 1 is a distal end perspective view of the pry bar having the ergonomic handle of the present invention.

Referring to FIGS., there is shown pry bar 10 of the present invention. Pry bar 10, in general terms, includes handle 11 and a fixedly attached metal blade or shank 12. Handle 11 has a proximate end 13 and a planar distal end 14. Blade 12 has a proximate end 15 and a distal end 16. Handle 11 is formed of a hard thermoplastic molded core 17 and a molded over integrally bonded elastomeric soft grip cover 18, wherein cover 18 is formed of relatively soft elastomeric material. The proximate end 15 of blade 12 is securely fixedly molded in core 17, with the formation of core 17. The elastomeric cover 18 is then molded over or around specific portions of the core 17, as further discussed hereinafter. Blade 12 is of generally square cross-sectional bar stock construction and has a proximate end 15 and a distal end 16. Proximate end 15 is molded in situ with core 17, so as to be fixedly secured within handle 11, by means well known in the art.

A metal impact cap 50 is fixedly disposed at the distal end of the handle 11. Cap 50 is secured within the handle core 17 by means well known in the screwdriver handle art. Cap 50 is used, by way of example, to impact screw heads prior to driving same. In molding handle core 17 around blade 12 a rectilinear hole 91 is formed in the handle distal end. The proximate end of core 17 is however formed with a circular cylindrical hole 92 for forcibly fixedly holding metal cap 50 in the handle proximate end.

Blade distal end 16 is formed with a pry end 53. Pry end 53 has outwardly tapered sides 54, and upper and lower surfaces 56 and 57. Surfaces 56 and 57 are tapered and extend towards sharpened edge or tip 58. Tip 58 is upwardly angularly disposed with respect to shank 12.

The elastomeric cover 18 does not cover the entire core 17. Four planar thermoplastic surfaces 17*a*-17*d* are left uncovered in the grip area of the handle, as best shown in FIG. 5.

Figure 2:
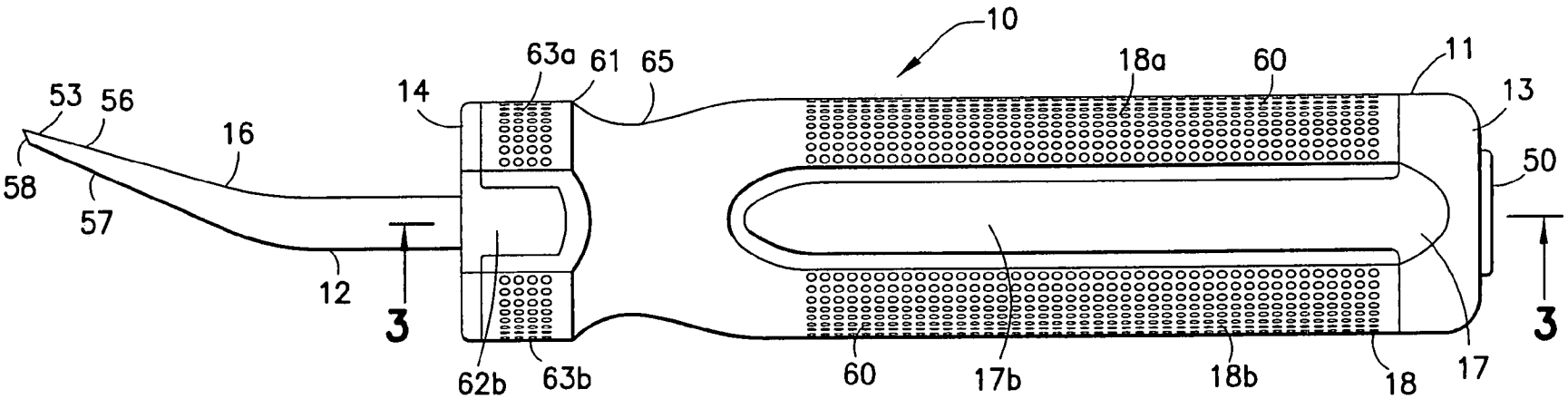
FIG. 2 is a side elevational view of the pry bar of FIG. 1.

Elastomeric material cover 18 is molded over hard thermoplastic core 17 in the handle grip portion in four curved or rounded grip portions 18*a*-18*d*, as best shown in FIGS. 2 and 5. The rounded elastomeric grip portions 18*a*-18*d* alternate with the planar hand plastic grip portions 17*a*-17*d*. Elastomeric grip portions 18*a*-18*d* are formed with a plurality of rows of small crevices or holes 60 (typical). It is believed that the surfaces 17*a*-17*d*, 18*a*-18*d* in further combination with the small holes provides improved grip and comfort for the user.

Figure 3:
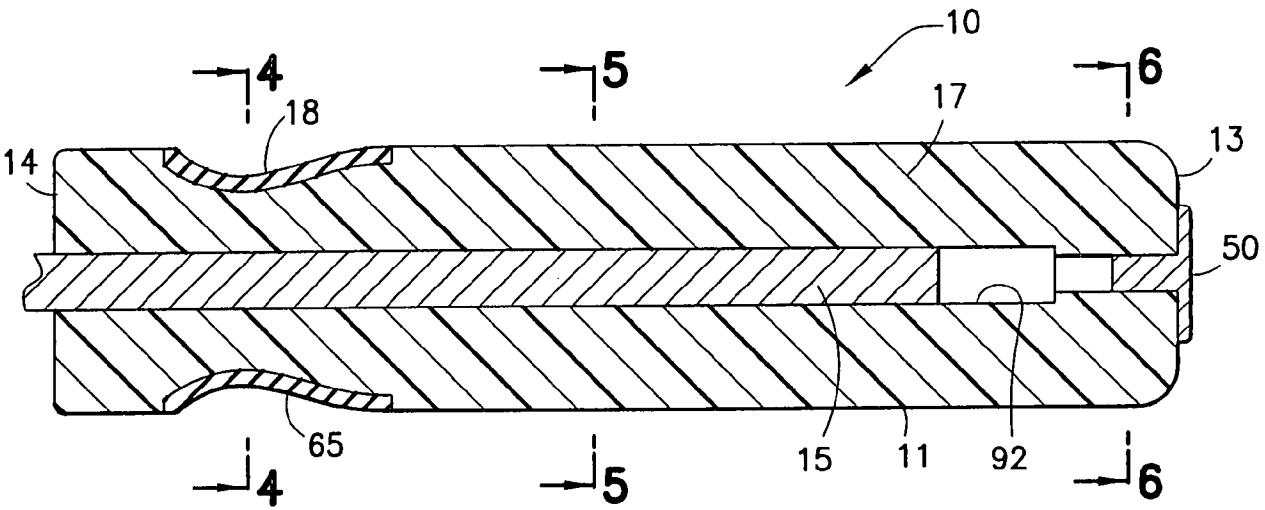
FIG. 3 is a sectional view taken along line 3-3 of FIG. 2.

Handle 11 is formed with a distal end portion 61 juxtaposed to planar end 14. Distal end portion 61 is formed with alternate hard plastic planar surfaces 62*a*-62*d*, and elastomeric rounded surface 63*a*-63*d* which are formed and configured similarly to respective surfaces 17*a*-17*d* and 18*a*-18*d*. Elastomer cover 18 extends from grip portions 18*a*-18*d* to respective distal end portions 63*a*-63*d* and entirely covers thermoplastic core 17 at cylindrical cross-sectional recessed portion 65, as best shown in FIGS. 2, 3 and 4.

In the aforesaid manner of construction, the user grips portions 18*a*-18*d* and 17*a*-17*d* and places the thumb in recessed portion 65, or if desired, on one of the distal end surfaces 63*a*-63*d* for best desired grip and comfort.

The core may be molded of hard thermoplastic using and the cover may be molded of with elastomeric material by molding methods.

The afore-discussed handle surfaces and contours, and in conjunction with the pry bar configuration and disposition with respect to the handle, provides an ergonomic pry bar.

The invention contemplates an ergonomic handle for both pry bar and other hand tools.

In the aforesaid manner of construction, there is provided a ergonomic pry bar and handle.

While the foregoing describes certain embodiments of the invention, various modifications and changes may be made within the spirit and scope of the invention, as defined by the adjoined claims.

What is claimed is:

1. A hand tool comprising:

a handle having a distal end, a proximate end and a grip portion of generally octagonal cross-section, said handle comprising an inner thermoplastic material core and outer integrally bonded elastomeric material, a blade, said blade having a proximate end and a distal end, said blade proximate end being fixedly secured within said handle, said grip portion having an outer surface comprising eight grip surfaces, four grip surfaces comprising elongate planar surfaces and four grip surfaces comprising elongate curvilinear surfaces, said four planar surfaces comprising said thermoplastic material, and said four curvilinear surfaces comprising elastomeric material, and said handle distal end comprising a thumb engaging portion, said thumb engaging portion having a generally octagonal cross-section comprising eight outer thumb receiving surfaces, four thumb receiving surfaces comprising planar surfaces and four thumb receiving surfaces comprising curvilinear surfaces, said four thumb receiving planar surfaces comprising said thermoplastic material, and said four thumb receiving curvilinear surfaces comprising elastomeric material, further comprising a metal impact cap disposed at the handle proximate end, and wherein the blade proximate end is adjacent to and facingly disposed to the metal impact cap, said handle having a distal end, said distal end comprises eight edges comprising 4 straight edges and 4 curvilinear edges, each edge being immediately juxtaposed to a respective thumb receiving surface, said handle comprising a rectilinear bore, said rectilinear bore extending distally from within the handle and terminating in a distal end rectilinear opening, whereby a rectilinear pry bar blade may be fixedly molded in the handle bore.

2. The hand tool of claim 1, each said thermoplastic material grip surface and each said elastomeric material grip surface being about equal.

3. The hand tool of claim 1, said elastomeric material grip surfaces being formed with a plurality of orifices.

4. The hand tool of claim 1, said thumb receiving elastomeric material surfaces being formed with a plurality of orifices.

5. The hand tool of claim 1, said thumb receiving thermoplastic material surfaces alternating with said thumb receiving elastomeric material surfaces.

6. The hand tool of claim 1, wherein the elastomeric material grip surface extends from the grip portion to the handle distal end.

7. The hand tool of claim 1, wherein the thermoplastic material is harder than the elastomeric material.

8. The hand tool of claim 1, wherein the handle comprises a cylindrical cross-sectional recessed portion.

9. The hand tool of claim 1, wherein the handle recessed portion adjacent the handle distal end has an outer surface entirely covered by the elastomeric material.

10. The hand tool of claim 8, wherein each thermoplastic material grip surface extends from the handle proximate end to the recessed portion.

11. The hand tool of claim 8, said grip portion elastomeric material comprises orifices disposed at the surface, and said elastomeric material in the recessed portion being free of said orifices.

12. The hand tool of claim 1, wherein the hand tool is a pry bar.

13. A pry bar comprising:

a handle having a distal end, a proximate end and a grip portion, said grip portion having a generally octagonal cross-section, said handle further comprising an inner thermoplastic core and an outer integrally bonded elastomeric material, said grip portion having an outer surface comprising a plurality of grip surfaces comprising a plurality of elongate planar surfaces and a plurality of elongate curvilinear surfaces, said planar surfaces comprising said thermoplastic material, and said four curvilinear surfaces comprising said elastomeric material, and said handle distal end comprises a thumb engaging portion, said thumb engaging portion comprises a plurality of thumb receiving surfaces comprising planar surfaces and curvilinear surfaces, said planar surfaces comprising said thermoplastic material, and said curvilinear surfaces comprising said elastomeric material, a rectilinear blade, said blade having a proximate end and a distal end, said blade proximate end being disposed within said handle, said blade being elongate and having a longitudinal axis, said blade distal end being formed in an angular disposition with respect to said blade longitudinal axis; said handle having a distal end, said handle distal end comprises eight edges comprising straight edges and curvilinear edges, each said edge being immediately juxtaposed to a respective thumb receiving surface, said handle further comprises a rectilinear bore, said rectilinear bore extending distally from within the handle and terminating in a distal end rectilinear opening, and the rectilinear blade is fixedly disposed in the handle bore and further comprising a metal impact cap fixedly disposed in the handle proximate end whereby the handle grip portion is capable of being gripped by a user with a thumb disposed on one of the thumb receiving surfaces and such that the user may apply pry bar leverage to the angularly disposed blade distal end or alternatively grips the grip portion and strike an element with the impact cap.

14. A pry bar comprising:

a handle having a distal end, a proximate end and a grip portion, said grip portion having a generally octagonal cross-section, said handle further comprising an inner rectilinear thermoplastic core and an outer integrally bonded elastomeric material, said grip portion having an outer surface comprising a plurality of grip surfaces comprising a plurality of elongate planar surfaces and a plurality of elongate curvilinear surfaces, said planar surfaces comprising said thermoplastic material, and said four curvilinear surfaces comprising said elastomeric material, and said handle distal end comprises a thumb engaging portion, said thumb engaging portion comprises a plurality of thumb receiving surfaces comprising planar surfaces and curvilinear surfaces, said planar surfaces comprising said thermoplastic thumb receiving curvilinear surfaces comprising said elastomeric material, a pry bar blade, said blade having a proximate end and a distal end, said blade being elongate and comprises a rectilinear cross-section portion, said blade distal end being formed in an angular disposition with respect to said elongate blade portion, said handle distal end comprises at least 4 edges, said edges comprise straight edges and curvilinear edges, each said edge being immediately juxtaposed to a thumb receiving surface, said handle further comprises a through bore having a longitudinal axis, said handle bore comprises a rectilinear bore portion, said rectilinear bore portion extends distally from within the handle and terminates at the handle distal end, said rectilinear blade portion being fixedly disposed in the handle rectilinear bore portion, and further comprising a metal impact cap fixedly disposed in the handle proximate end, whereby the is capable of being gripped by a user with a thumb disposed on one of the thumb receiving surfaces and such that the user may apply pry bar leverage to the angularly disposed blade distal end or alternatively grip the handle grip portion and strike an element with the impact cap.

* * * * *